United States Patent [19]

Ballard

[11] 4,193,559

[45] Mar. 18, 1980

[54] FILM WEB WINDING ASSEMBLY

[75] Inventor: Raymond M. Ballard, Lancaster, Ohio

[73] Assignee: E. I. Du Pont de Nemours and Company, Wilmington, Del.

[21] Appl. No.: 894,550

[22] Filed: Apr. 7, 1978

[51] Int. Cl.[2] ..... B65H 17/02

[52] U.S. Cl. ..... 242/67.1 R; 29/113 R

[58] Field of Search ..... 242/67.1 R, 68.5, 65, 242/66, 55, 72 B, 72 R; 29/110, 113 R, 121.4; 100/162 R, 163 R

[56] References Cited

U.S. PATENT DOCUMENTS

| | | | |
|---|---|---|---|
| 3,224,698 | 12/1965 | Conti | 242/55 |
| 3,410,499 | 11/1968 | Schmidt | 242/67.1 R |
| 3,503,567 | 3/1970 | Casey | 242/67.1 R |
| 3,707,749 | 1/1973 | Henley | 29/113 R |
| 3,779,154 | 12/1973 | Arendt | 29/113 R |
| 3,843,366 | 12/1974 | Collet | 29/113 R |

*Primary Examiner*—Edward J. McCarthy

[57] ABSTRACT

A web winding assembly of rolls is disclosed. The assembly includes a winding roll and a layon roll. The layon roll is of constant circumference with a flexible surface and is characterized by having an incompressible core, a volumetrically compressible resilient cushion element on the core, and a flexible, inextensible, outer covering on the cushion element. The winding assembly is used in film web handling operations to make windup packages of film web having improved surface hardness character and reduced tendency to telescope.

15 Claims, 4 Drawing Figures

FILM WEB WINDING ASSEMBLY

DESCRIPTION

1. Technical Field

In film web winding operations whereby a web is transported through a rolling nip and laid onto a windup of web material, the web should be contacted with substantially equal force along the entire length of the nip. This invention relates to a web winding assembly which provides such substantially equal force.

Webs which are transported through rolling nips are often subjected to severe longitudinal and transverse stresses at and near the nips as a result of undesirable deformation of the nip rolls. The stresses can cause wrinkling, creasing, scratching, and rupture of the webs and can result in unacceptable wound roll products. This invention relates to a web winding assembly which causes reduced stresses in rolling nips and which produces improved wound roll products, hereinafter termed windups.

2. Background Art

Rolls which have customarily been used for transporting and winding webs have been made to have surfaces which are either resilient and stretchable or rigid. U.S. Pat. No. 3,756,760 issued Sept. 4, 1973 discloses a finishing roll for impressing the surface of molten polymer sheets. There is no disclosure in that patent of a web winding assembly of rolls or of producing windups of web material.

U.S. Pat. No. 3,633,493 issued Jan. 11, 1972 discloses a web processing roll assembly having a variable deflection roll with a compressible inner element. In operation, the rigid shell of the variable deflection roll comes into contact with the surface of another roll and, by the forces of contact, the shell is eccentrically displaced from the axis of the variable deflection roll. The web processing roll therein provides only for adjustment of the distance between the parallel axes of the variable deflection roll and a roll in contact therewith. There is no provision for controlling contact forces along the nip of the roll assembly to accommodate transverse irregularities in a web being processed; and there is no provision for producing windups of web material.

U.S. Pat. No. 3,543,366 issued Dec. 1, 1970 discloses a calendering roll which includes a rigid casing supported on a main shaft by means of individually inflatable annular chambers. There is no disclosure in that patent of a web winding assembly of rolls or of producing windups of web material.

U.S. Pat. No. 689,590 issued Dec. 24, 1901 discloses an inflatable inking roller wherein a pressurized resilient tube is wound around a rigid core and covered by an absorbent and inelastic canvas which is, in turn, covered with an additional soft absorbent material. There is no disclosure in that patent of a web winding assembly of rolls or of producing windups of web material.

DISCLOSURE OF INVENTION

According to the present invention there is provided a film web winding assembly of a winding roll with a core and a plurality of layers of film web wound thereon, a layon roll in nip contact with the winding roll, having a constant circumference, an incompressible core, a volumetrically compressible resilient cushion element on the core and a flexible, inextensible outer covering exerting a substantially equal pressure against the winding roll along the entire length of the winding roll.

In operation, the assembly includes a moving film web of indeterminate length contacting the rotating winding roll and the rotating layon roll at the nip and being wound onto the winding roll; — the web and the surface of the winding roll and the layon roll all moving at substantially equal velocities.

The present invention includes a process for winding a film web comprising the steps of moving or transporting a film web of indeterminate length at a particular velocity along the longitudinal axis; winding the web onto a rotating winding roll comprising a core and a plurality of layers of the moving film web; and contacting the winding roll with a rotating layon roll to yield a nip at the point where the web first contacts the winding roll, the layon roll comprising an incompressible core, a volumetrically compressible resilient cushion element on the core and a flexible, inextensible, outer covering on the cushion element, the layon roll having a constant circumference, the velocity of the moving film web being substantially equal to the surface velocities of the winding roll and the layon roll, and the nip pressure being substantially equal along the entire length of the winding roll.

In web slitting operations, the film web winding assembly of this invention is useful to produce slit web windups. When a gauge band is present in a web to be slit, substantially different radii occur in neighboring slit web windups due to the thickening effect of gauge bands located in individual windups. The increased thickness of a gauge band is accumulated by each additional layer wound onto the windup, thus, resulting in a substantially increased radius for that windup. Adjacent windups, outside the gauge band width, do not exhibit the increased radius. The assembly of this invention, with its layon roll of volumetrically compressible cushion element and flexible but inextensible covering element, exerts substantially equal pressure on all slit web windups even when some of the windups have radii substantially different from the radii of their neighbors.

The assembly of this invention is useful to produce windups of full width and exhibits advantage over assemblies of the prior art in such use. Resilient but volumetrically incompressible layon rolls with stretchable surfaces have previously, generally, been used in web winding assemblies. Such incompressible layon rolls bulge at either side of the nip and the surface of such rolls is stretched in the nip itself. As a consequence of such surface stretching, any web material taken into the nip is also subjected to stretching forces. A web which is stretched in the nip of the assembly will result in an undesirably hard windup and such a web may even be scratched and severely and permanently distorted in the vicinity of gauge bands across the web. Stretching in the nip is a function of the resilience of the rolls and the stretching can be decreased by decreasing the resilience of one or both rolls making the nip. Harder rolls, however, tend to bounce at high speeds making it difficult to apply a constant force to a web in winding operations.

Volumetrically compressible rolls having an elastic perimeter have also previously been used as layon rolls. Such rolls are compressed in the nip of the roll assembly and, as a result, the roll perimeter is shortened in the nip and web material taken into the nip is also compressed or shortened. Such a shortened web, leaving the nip for application to a windup, will result in a loose, soft, roll having a tendency to telescope.

The roll assembly of this invention is used to produce windups of excellent quality having a proper hardness and a low tendency to telescope. The quality of a windup is believed to be a function of the amount of air wound into the roll in its formation and wound-in air is minimized by having a nip which exerts a constant pressure across the web. As was discussed for slit web windups, wound rolls of full web width also exhibit irregularities caused by accumulated gauge band thickening. In rolls of full web width, such accumulations may, additionally, cause web stretching on either side of the irregularity, thus compounding the problem and reducing windup quality even further. The roll assembly of this invention, having a layon roll of constant perimeter and a surface flexible and conformable not only to web gauge bands and irregularities but also to roll-to-roll deformations, exerts a constant nip pressure on a web in the nip through the entire width and across the entire length of the nip area.

As to the elements of the film web winding assembly of this invention, the layon roll has an incompressible core which can be any solid or rigid support member such as a metal cylinder or the axle of the roll. The core serves as the carrier for the other layon roll elements and provides means for mounting the roll on a frame for operation.

The cushion element of the layon roll can be made using any volumetrically compressible resilient material. The cushion can, if desired, be adhered or otherwise attached to the core. Examples of eligible cushion materials include rubber or other resilient elastomer in the form of foams, hollow tubes, or other voided, compressible, structure. Hollow tubes are preferred as the cushion elements; and the tubes can be helically wound on the incompressible core or they can be in the configuration of a plurality of rings which are individually mounted on the core.

Helically wound resilient hollow tubing as the compressible cushion element provides a continuous void around the layon roll from one end of the roll to the other. The ends of the tubing can be open to the atmosphere or closed and, if closed, the pressure in the hollow space of the tubing can be above or below atmospheric pressure. By adjusting the pressure in the hollow space of the tubing, the resilience of the tubing can be altered somewhat. Reduced pressure results in tubing which is more resilient or more easily compressed while increased pressure results in a cushion element with increased firmness. In the use of helically wound hollow tubing, whether open at the ends or sealed, a substantially constant pressure and a substantially constant resilience is insured over the entire layon roll surface.

The cushion material of the layon roll is preferably filled with a gas such as air to assure compressibility. The necessary qualities of the cushion element are volumetric compressibility and resilience. If it is desired or required for some purpose, such as to improve heat transfer, the cushion material can be filled with a liquid so long as the cushion material is located or spaced on the core to provide volumetric compressibility by permitting distention of the cushion material, itself.

The flexible, inextensible, outer covering of the layon roll can be any material of a kind and thickness to provide adequate flexibility without stretching, although metal is not preferred. The outer covering is preferably organic polymeric material, can be a continuous sheet or a woven or otherwise fibrous fabric, and can be a laminate combination of materials. Proper operation of the film web winding assembly of this invention depends, in large part, upon the flexibility of the covering material on the layon roll. Metallic sheet covering of, for example, nickel or stainless steel must generally have a thickness of less than 0.1 millimeters to retain an acceptable flexibility. Such thin metal sheeting is subject to tearing and creasing in operations requiring a high degree of resilience. On the other hand, nonmetallic, polymeric covering material, especially of the woven or laminate variety, exhibits high toughness and strength and can be fabricated in thicknesses of greater than 2.0 millimeters with acceptable flexibility. An outer covering of polymeric material is preferred for the layon roll and a laminate of woven or fibrous polymeric materials is especially preferred.

DESCRIPTION OF THE DRAWINGS

Reference is made to the drawings to ensure a complete understanding of the film web winding assembly of this invention.

In FIG. 1, layon roll 5 is shown in nip contact with winding roll 6 to form the film web winding assembly of this invention. Layon roll 5 is rotatably mounted on a frame (not shown) by means of axle 7 and winding roll 6 is rotatably mounted on a frame (not shown) by means of axle 8 which axles, optionally, extend through the rolls. Either layon roll 5 or winding roll 6, or both, can be driven. Layon roll 5 has an incompressible core 9 on which is placed a volumetrically compressible resilient cushion element 10. The cushion element 10 is covered by a flexible, inextensible, outer covering 11. Winding roll 6 includes a winding of a multitude of layers of web W on rigid shell 12. Shell 12 can be solid. Similarly, the incompressible core 9 of layon roll 5 can be solid. It is understood that the radius of winding roll 6 is increased as web W is wound thereon; and it is also understood that winding roll 6 may consist of several windups of slit web material on a common mandrel and, in that case, roll 5 nips each windup with substantially equal pressure. Volumetrically compressible resilient cushion element 10 is, as specified above, preferably a helically wound tubing of elastomeric material.

In FIG. 2, the layon roll 5 is shown, by end view cross section, in nip contact with a portion of winding roll 6. Winding roll 6 includes a winding of a multitude of layers of web W on rigid shell 12. The extent of contact between layon roll 5 and winding roll 6 as well as the deflection of the surface of layon roll 5 is exaggerated for the purpose of illustration to show the relationship of the rolls in the assembly of this invention. Outer covering 11 is inextensible and the outer perimeter of layon roll 5 is thereby maintained constant regardless of the degree of surface deflection in the roll caused by contact with other bodies. Volumetrically compressible resilient cushion element 10 is located between core 9 and outer covering 11 and provides for a uniform force against covering 11 and any contacting body such as winding roll 6. The area of contact between layon roll 5 and winding roll 6 is termed the footprint and the end view of the footprint is designated in FIG. 2 as the line ab. Because covering 11 is inextensible, the footprint for a nip involving layon roll 5 of this invention is exactly the same width as the distance from a to b on layon roll 5 when the roll is not contacting a deflecting surface. In operation of the film web winding assembly, web W is moved through the nip and every element of the surface of layon roll 5 and every element of the surface of winding roll 6 move at the same velocity, thereby eliminating any shearing forces between the rolls in the assembly and thus preventing shear forces on the web as it traverses the footprint.

In the film web winding assembly of the present invention, the combination of flexible but inextensible covering and volumetrically compressible resilient cushion element in the layon roll 5 operates to provide a roll surface in the assembly construction which, when deflected by nip contact with other surfaces, may exhibit a minute change in overall radius to account for the deflection.

Figure 1:
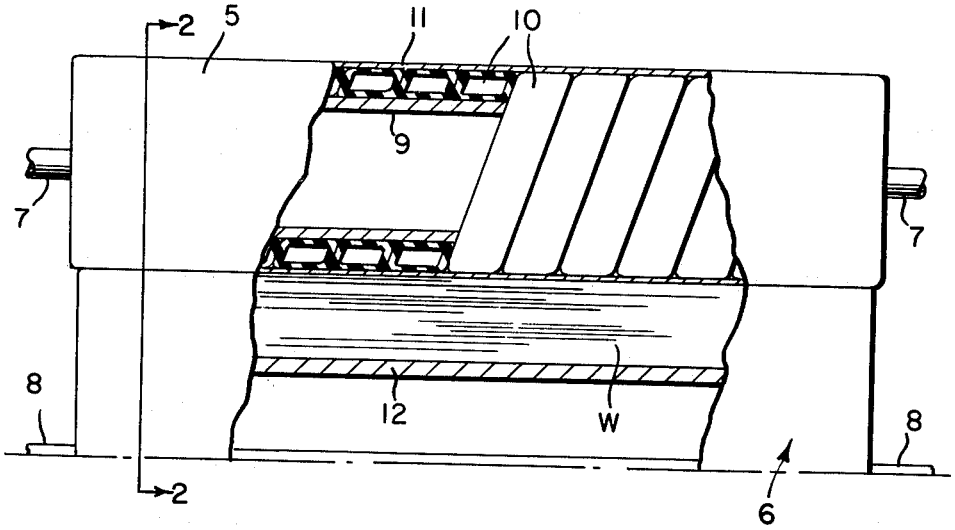
FIG. 1 represents the film web winding assembly in partial cross section. The assembly of FIG. 1 includes a layon roll in nip contact with a winding roll.
Figure 2:
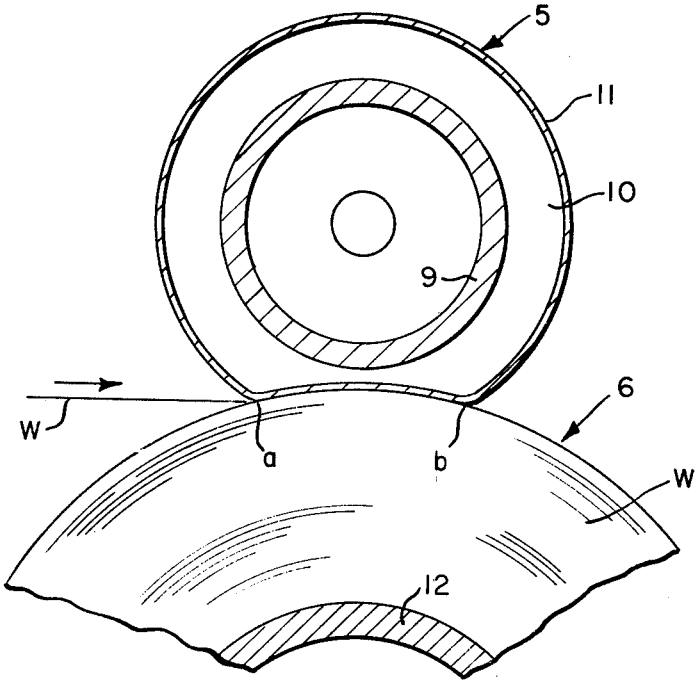
FIG. 2 represents an end view, in cross section, of a film web winding assembly of this invention with a layon roll in nip contact with a winding roll.
Figure 3:
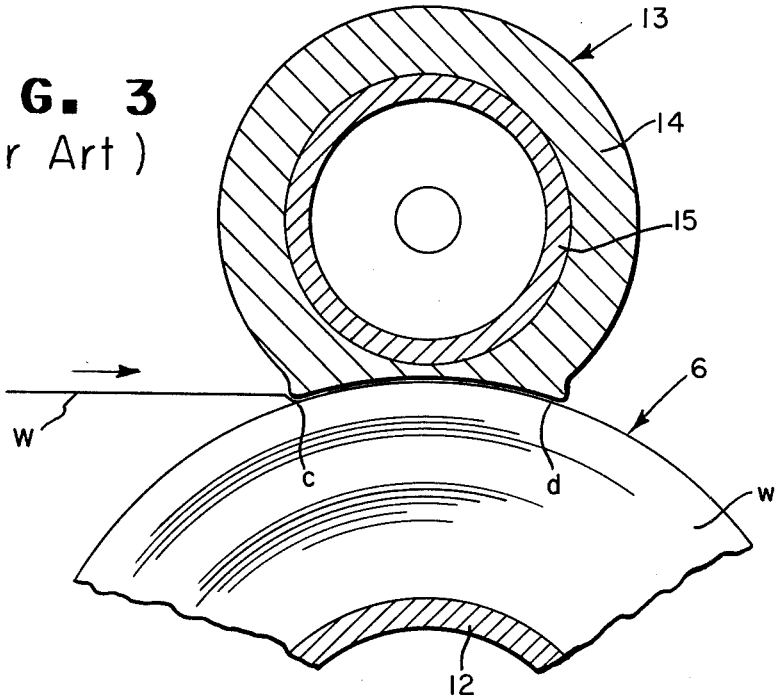
FIG. 3 (Prior Art)
FIG. 3 represents an end view, in cross section, of a volumetrically incompressible layon roll of the prior art in nip contact with a winding roll.

In FIG. 3, an assembly of the prior art is shown wherein roll 13 is a cross-sectional schematic representation of a resilient roll having a resilient but volumetrically incompressible outer element 14 mounted on a rigid incompressible core 15. Outer element 14, being substantially incompressible, exhibits localized bulging on any contact with a deflecting body, such as a winding roll 6, a portion of which is shown in cross section. Winding roll 6 includes a winding of a multitude of layers of web W on rigid shell 12. Bulging of outer element 14 is accompanied by a locally elongated roll perimeter and a tendency for incrementally different velocities for corresponding elements of the surfaces of rolls 13 and 6. The tendency for incrementally different velocities may be exhibited as actual slippage between the rolls or as shear forces which stretch and distort web W transported through a rolling nip of the rolls. The footprint of roll 13 in this assembly is cd. As web W enters footprint cd and the surface of roll 13 stretches, shear forces are exerted to stretch web W. As web W leaves footprint cd and the surface of roll 13 returns to its previous length, web W is released to recover from the effects of the shear forces in whatever manner conditions permit.

Figure 4:
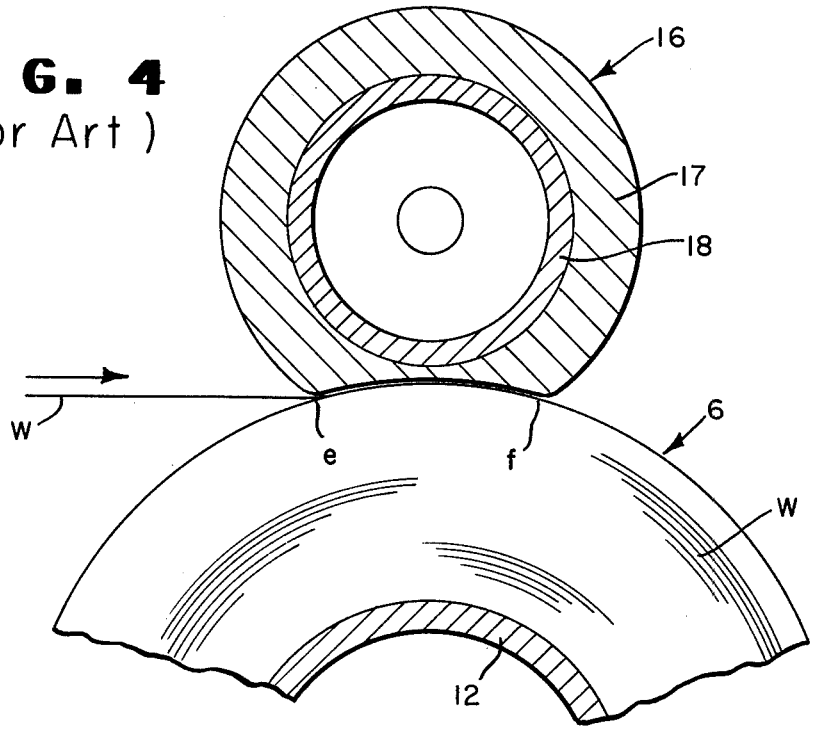
FIG. 4 (Prior Art)
FIG. 4 represents an end view, in cross section, of a volumetrically compressible layon roll of the prior art in nip contact with a winding roll.

In FIG. 4, an assembly of the prior art is shown wherein roll 16 is a cross-sectional schematic representation of a resilient roll having a resilient and volumetrically compressible outer element 17 mounted on a rigid incompressible core 18. Outer element 17, generally an elastomeric foam element, is volumetrically compressible and any contact with a distorting body, such as a winding roll 6, causes localized compressing of the element at the point of contact. A portion of winding roll 6 is shown in cross section and includes a winding of a multitude of layers of web W on rigid shell 12. Compression of element 17 results, as in the case of roll 13 in FIG. 3, in a tendency for different velocities between the contacting surfaces of rolls 16 and 6. The footprint of the roll assembly in FIG. 4 is ef. As web W enters footprint ef and the surface of roll 16 contracts, shear forces are exerted to contract web W. As web W leaves footprint ef and the surface of roll 16 returns to its initial, uncontracted, length, web W is released to recover from the effects of the shear forces in whatever manner conditions permit. A roll 16 used in a layon operation, results in a loosely wound roll of web material because the contracted web material recovers from the effects of the shear forces after being applied to roll 6.

BEST MODE AND INDUSTRIAL APPLICABILITY

A specific, preferred, layon roll for use in the film web winding assembly of this invention has the following specifications: For the incompressible core, an aluminum pipe about 10 centimeters in diameter is fitted at each end by a plug into which is mounted a shaft for mounting the layon roll. The pipe wall thickness is selected to provide adequate rigidity and bending strength. For example, a layon roll 1.5 meters long can be made using pipe with a wall thickness of 1 centimeter. The volumetrically compressible resilient cushion element is made from natural rubber tubing having an outside diameter of about 1.6 centimeters and a wall thickness of about 0.25 centimeters. The tubing is wound onto the core firmly but without stretching from one end of the core to the other. The outer covering element is a laminate of materials including neoprene and strands of aromatic polyamide fiber. The laminate can be constructed from: an inner layer about 1.25 millimeters thick composed of the strands encased in neoprene wherein the strands are about 1500 denier and are aligned with the axis of the roll at a spacing of about 15 strands per centimeter; a center layer about 0.75 millimeters thick composed of the same strands aligned in a spiral winding around the roll at a spacing of about 15 strands per centimeter; and an outer layer about 1.25 millimeters thick of neoprene. The neoprene is from a gum stock which results, when cured, in durometer hardness of 50–60 by determination using a Shore "A" Durometer Tester sold by the Shore Instrument and Manufacturing Company, Jamaica, New York, U.S.A. An exemplary aromatic polyamide fiber is sold by E. I. du Pont de Nemours and Company under the trademark designation Kevlar®. The outer covering is placed on the cushion element so as to be held in position by radial forces exerted by the cushion element against the covering.

For the winding roll, any core material commonly used for winding roll cores, can be used.

While benefits of the film web winding assembly of this invention can be found in cases wherein expected deflections in the winding rolls are slight, for example, on the order of only 0.1 millimeters or less, the benefits are especially realized in cases wherein the winding roll deflections are greater, for example, on the order of 0.50 to 2.0 millimeter or greater. The above-described, preferred, layon roll can be used, for example, with winding rolls having a core of about 20 centimeters in diameter wound with film material, such as polyethylene terephthalate film, to a diameter of 50 to 75 centimeters, or more. During the making of such a windup, deflections of as much as three or four millimeters might be expected or required.

The film web winding assembly of this invention finds use in winding web materials generally and is especially useful in winding polymeric webs and films, including polyethylene terephthalate and other polyesters; polyethylene and propylene and other polyolefins; and other materials such as regenerated cellulose, polyamides, polyimides, and the like.

In the layon roll for the film web winding assembly, it has been found to be of additional benefit to use a sleeve of film material having very low coefficient of friction as the outermost layer of whatever laminate structure is used for the outer covering. For example, in the layon roll specifically described above, a film of fluorocarbon polymer having a thickness of about 0.5 millimeters is applied to the neoprene layer. An exemplary fluorocarbon polymer is sold by E. I. du Pont de Nemours and Company under the trademark designation Teflon ®FEP.

I claim:

1. A film web winding assembly consisting essentially of:

(a) a winding roll with
  (i) a core and
  (ii) a plurality of layers of film web wound thereon, (b) a layon roll in nip contact with the winding roll, having a constant circumference, and comprising
  (i) an incompressible core
  (ii) a volumetrically compressible resilient cushion element on the core and
  (iii) a flexible, inextensible, outer covering on the cushion element, the outer surface of the outer covering exerting a substantially equal pressure against the winding roll along the entire length of the winding roll.

2. The film web winding assembly of claim 1 wherein the volumetrically compressible resilient cushion element of the layon roll is elastomeric, hollow tubing helically wound on the core.

3. The film web winding assembly of claim 2 wherein the hollow space of the tubing is at atmospheric pressure.

4. The film web winding assembly of claim 2 wherein the hollow space of the tubing is above atmospheric pressure.

5. The film web winding assembly of claim 1 wherein the volumetrically compressible resilient cushion element of the layon roll is a plurality of resilient hollow tubing rings.

6. The film web winding assembly of claim 1 wherein the volumetrically compressible resilient cushion element of the layon roll is a resilient foam.

7. The film web winding assembly of claim 1 wherein the outer covering of the layon roll is held on the cushion element by radial forces exerted by the cushion element against the outer covering.

8. The film web winding assembly of claim 2 wherein the tubing is adhered to the core.

9. The film web winding assembly of claim 7 wherein the outer covering is a laminate of organic polymeric materials.

10. The film web winding assembly of claim 9 wherein the laminate of polymeric materials comprises strands of aromatic polyamide fibers encased in an elastomeric binder material.

11. The film web winding assembly of claim 10 wherein the elastomeric binder material is neoprene.

12. The film web winding assembly of claim 7 wherein the outer covering includes, as an outermost layer, a sleeve of fluorocarbon polymer material.

13. The film web winding assembly of claim 11 wherein the outer covering includes, as an outermost layer, a sleeve of fluorocarbon polymer material.

14. A film web winding assembly, in operation, consisting essentially of:

(a) a moving film web of indeterminate length;

(b) a rotating winding roll with
  (i) a core and
  (ii) a plurality of layers of the moving film web wound thereon, the outermost layer of which moving film web has a velocity substantially equal to that of the moving film—the rotating winding roll continually winding the moving film web thereon; and (c) a rotating layon roll in nip contact with the rotating winding roll, the rotating layon roll having a constant circumference with
  (i) an incompressible core
  (ii) a volumetrically compressible resilient cushion element on the core and
  (iii) a flexible, inextensible, outer covering on the cushion element, the outer surface of the outer covering having a velocity substantially equal to that of the moving film and exerting a substantially equal pressure against the moving film web wound onto the rotating winding roll, along the entire length of the rotating winding roll.

15. A process for winding a film web comprising:

(a) moving a film web of indeterminate length along its longitudinal axis;

(b) winding the web onto a rotating winding roll comprising
  (i) a core and
  (ii) a plurality of layers of the moving film web; and (c) contacting the rotating winding roll with a rotating layon roll to yield a nip at the point where the web first contacts the winding roll, the layon roll comprising
  (i) an incompressible core,
  (ii) a volumetrically compressible resilient cushion element on the core and
  (iii) a flexible, inextensible, outer covering on the cushion element, the layon roll having a constant circumference, the velocity of the moving film web being substantially equal to the surface velocities of the winding roll and the layon roll, and the nip pressure being substantially equal along the entire length of the winding roll.

* * * * *